United States Patent [19]

Takeuchi et al.

[11] 4,122,981

[45] Oct. 31, 1978

[54] TONER DISPENSING DEVICE HAVING RECIPROCATING DISPENSING PLATE AND AGITATOR

[75] Inventors: Koji Takeuchi, Gamagori; Syotaro Inagaki, Okazaki, both of Japan

[73] Assignee: Minolta Camera Kabushiki Kaisha, Osaka, Japan

[21] Appl. No.: 729,602

[22] Filed: Oct. 4, 1976

[30] Foreign Application Priority Data

Oct. 18, 1975 [JP] Japan ..... 50-142296[U]
Oct. 25, 1975 [JP] Japan ..... 50-145674[U]
Aug. 20, 1976 [JP] Japan ..... 51-112158[U]

[51] Int. Cl.[2] ..... G01F 11/10

[52] U.S. Cl. ..... 222/231; 222/245; 222/284; 222/359

[58] Field of Search ..... 222/231, 243, 244, 245, 222/276, 284, 359, 361, 345, 409, 194

[56] References Cited

U.S. PATENT DOCUMENTS 2,176,562 10/1939 Rose ..... 222/284 X
3,576,280 4/1971 Ahmann et al. ..... 222/DIG. 1
3,692,403 7/1972 Turner ..... 222/DIG. 1
3,941,470 3/1976 Shah ..... 222/DIG. 1

FOREIGN PATENT DOCUMENTS 1,122,376 11/1972 Fed. Rep. of Germany ..... 222/194

*Primary Examiner*—Robert B. Reeves
*Assistant Examiner*—David A. Scherbel

[57] ABSTRACT

A toner dispensing device for use in a developing apparatus of an electrophotographic copying machine. The device includes a toner tank mounted on the developing apparatus, a horizontal slit formed at a lower portion of the toner tank, a toner supplying plate which is adapted to reciprocate through the slit for supplying toner at constantly uniform rates from a plurality of openings formed in the same plate, and a stabilizing plate pivotally disposed in the toner tank for dividing the toner tank into upper and lower portions. When the toner supplying plate strikes in its return motion against the stabilizing plate, a predetermined amount of toner is supplied from the upper portion into the lower portion through openings formed in the stabilizing plate for maintaining a predetermined amount of toner in the lower portion at a uniform density.

7 Claims, 18 Drawing Figures

TONER DISPENSING DEVICE HAVING RECIPROCATING DISPENSING PLATE AND AGITATOR

The present invention relates to an electrophotographic copying machine and more particularly, to a toner dispensing device for use in a developing apparatus of an electrophotographic copying machine.

BACKGROUND OF THE INVENTION AND PRIOR ART

Generally, in a dry process electrophotographic copying machine of the Xerographic or similar type, subsequent to projection of light images of an original to be copied onto a preliminarily charged photoreceptor surface for the formation of an electrophotographic latent image of the original thereon, the latent image is developed into a visible toner powder image by a developing apparatus disposed along the path of the photoreceptor. Accommodated in a housing of such a known developing apparatus are developing material composed of magnetizable carrier material and electroscopic toner powder, and a developing roller rotatably disposed adjacent to and in spaced relation to the photoreceptor and having a rotatable outer cylinder and a plurality of stationary magnets fixedly disposed in the outer cylinder for the formation of magnetic brush bristles of the developing material on the outer cylinder, which brush bristles rub against the latent image on the photoreceptor to develop the same into the visible toner powder image for subsequent transfer thereof onto transfer material such as copy paper. The toner dispensing device includes a toner tank filled with toner powder or toner particles which are supplied at predetermined rates into the housing of the developing apparatus for being mixed with the developing material housed in said housing and supplied onto the developing roller through developing material stirring and supplying means disposed adjacent to said developing roller. In the arrangement as described above, it is commonly required that the toner dispensing device be capable of supplying the toner particles at constantly uniform rates, with the toner particles being simultaneously prevented from undergoing the undesirable bridging phenomenon in the toner tank. On the other hand, following the general trend to increasing copying speeds in electrophotographic copying apparatuses, troublesome procedures for frequently replenishing the toner tank with toner powder are inevitably involved. In order to eliminate such inconveniences, large toner tanks tend to be employed, in which case, however, if a large amount of toner powder is housed in a toner tank, the density of toner powder at the lower portion of the toner tank increases due to the weight of the toner powder itself, and thus the amount of toner powser supplied through the lower portion of the toner powder supplied through the lower portion of the toner tank consequently increases due to its high density. However, when the amount of the toner powder in the toner tank is reduced through consumption, the toner powder around the lower portion of the toner tank is less affected by its weight, with consequent low density of the toner powder thereat and reduction in the amount supplied to the developing apparatus. In other words, due to the increase of toner tank size, the amount of toner powder to be supplied to the developing device varies depending on the amount of the toner housed in the toner tank, with consequent variations of toner concentration in the developing material housed in the developing apparatus housing. Such inconveniences not only result in unfavorable development, but also in hardening of the toner powder due to the high density thereof when a large amount of toner is housed in the toner tank.

In order to supply toner powder at predetermined constant rates, there has conventionally been proposed, for example, by IBM Technical Disclosure Bulletin (Vol. II No. 5 October 1968), a toner dispensing device as shown in FIGS. 1A to 1C. The prior art toner dispensing device includes a hopper or toner tank H filled with toner powder t for dispensing the toner at a predetermined rate into a developing chamber (not shown) of a copying machine. The hopper H further includes a pair of downwardly converging side walls H*a* and H*b* and a bottom wall formed by a resilient flap H*f* and a spring member H*s* which engages the flap H*f* adjacent to its point of contact with the wall H*a* of the hopper H, while a vertically movable dispensing member D is disposed within the hopper H and adjacent to the wall H*a*. The dispensing member D urged by a spring D*s* upwardly against a stationary stop H*p* has a dispensing blade portion D*b* which rides against the wall H*a* of the hopper H, with a cam follower portion D*c* which extends from the dispensing member D and which is engaged by a rotatable cam C. For dispensing the toner *t*, the cam C is rotated and as shown in FIG. 1B, a measured amount of toner *t* is trapped between the end of the blade D*b*, the wall H*a* of the hopper H, and the flap H*f*. The toner t thus trapped is dispensed as the flap H*f* is deflected upon continued downward movement of the blade D*b* as shown in FIG. 1C. The cam C is formed with a notch C*b* which causes an abrupt jump in the blade D*b* while it is below the flap H*f* to ensure that the toner *t* is removed from the end of said blade D*b*, and the feed rate is varied by adjusting the angular position of the flap H*f* to change the volume of the enclosure formed by the wall H*a* of the hopper H, flap H*f* and the lower end of the blade D*b*. The known toner dipensing device as described above, however, still has a disadvantage in that it is rather difficult to supply a constantly uniform amount of toner at all times due to its construction and supplying method based on the jumping action of the blade D*b*, and in that the undesirable bridging phenomenon of the toner within the toner tank H is not sufficiently prevented.

Furthermore, in conjunction with the foregoing arrangements of the conventional toner dispensing devices, the prior art developing meterial stirring and supplying means employed in the known developing apparatus is imperfect in its performance for stirring and supplying the developing material, with the toner particles not being uniformly and sufficiently charged triboelectrically by the carrier material, thus resulting in various inconveniences in achieving optimum development.

OBJECTS AND BRIEF SUMMARY OF THE INVENTION

Accordingly, an essential object of the present invention is to provide a toner dispensing device for use in a dry process developing apparatus of an electrophotographic copying machine which is capable of supplying toner constantly at predetermined uniform rates, with toner being simultaneously prevented from undergoing the undesirable bridging phenomenon in a toner tank, with substantial elimination of the disadvantages inherent in the conventional toner dispensing devices.

Another important object of the present invention is to provide a toner dispensing device of the above described type which can supply a uniform amount of toner powder at a proper density irrespective of the size of the toner tank and quantity of toner powder housed in the toner tank.

A further object of the present invention is to provide a toner dispensing device of the above described type which is associated with an improved developing material stirring and supplying means of a developing apparatus for effecting optimum development.

A still further object of the present invention is to provide a toner dispensing device of the above described type which functions accurately and has a simple construction and can be readily incorporated in various types of dry process copying machines.

According to a preferred embodiment of the present invention, the toner dispensing device includes a toner tank filled with toner powder and disposed above a developing apparatus which is located adjacent to and in spaced relation to the known photoreceptor drum, a slit laterally, horizontally formed at the lower portion of the toner tank and extending approximately the width of the photoreceptor drum, a toner supplying plate having a widthwise cross section similar to the shape of the slit and slidably received in said slit for reciprocating movement in a direction parallel to an inclined bottom wall of the toner tank, with the toner supplying plate being provided with a toner replenishing opening or openings formed adjacent to the front edge thereof and a toner bridging preventing projection formed at its rear edge within the toner tank, an operating plate movably disposed below the inclined bottom wall of said toner tank and connected to said toner supplying plate for simultaneous movement therewith by driving means, and a stabilizing plate pivotally disposed in the toner tank to divide the interior of said toner tank into upper and lower portions. By the above arrangement, a uniform amount of toner is constantly supplied into the developing apparatus from the toner replenishing openings filled with the toner as the toner supplying plate reciprocates through the slit, while the undesirable bridging of the toner within the toner tank is advantageously prevented by the presence of the bridging phenomenon preventing projection. Meanwhile, the stabilizing plate has a plurality of openings therein, around which desirable bridging phenomenon of the toner takes places for normally preventing the toner housed in said upper portion of the toner tank from falling through the openings into the lower portion so that the toner powder accommodated in said lower portion is unaffected by the weight of the toner in the upper portion, while the same stabilizing plate supported by the bridge preventing projection of the toner supplying plate in the retracted position of said toner supplying plate is disengaged from said preventing projection for pivotal movement thereof as the toner supplying plate is projected through said slit, and upon retraction of the toner supplying plate into the toner tank, the bridging preventing projection of the toner supplying plate strikes against the stabilizing plate for breaking the bridging of the toner on the stabilizing plate so as to allow the toner in the upper portion to fall into the lower portion of the toner tank through the openings of said stabilizing plate, and thus a predetermined amount of toner is constantly housed in the lower portion of the toner tank and is maintained at a uniform density, whereby inconveniences such as hardening of the toner in the lower portion due to the weight of the toner in the upper portion of the toner tank are advantageously prevented, with substantial elimination of the disadvantages inherent in the conventional toner dispensing devices. Furthermore, the toner dispensing device of the invention is associated with improved developing material stirring and supplying means housed in the developing apparatus and including a rotatable stirring roll having spring members wound thereon for engagement with a scraping plate for scraping developing material from a developing roller, and a stirring and supplying impeller member for efficient stirring and tribo-electrical charging of the toner particles with the carrier material, whereby copied images of high quality are produced.

BRIEF DESCRIPTION OF THE FIGURES

These and other objects and features of the present invention will become apparent from the following description taken in conjunction with the preferred embodiments thereof with reference to the accompanying drawings in which;

FIG. 1(A) is a fragmentary sectional view of a conventional toner dispensing device which has already been referred to;

FIGS. 1(B) and 1(C) are fragmentary sectional views, on an enlarged scale, showing important portions of the conventional device of FIG. 1(A);

DETAILED DESCRIPTION

Figure 1:
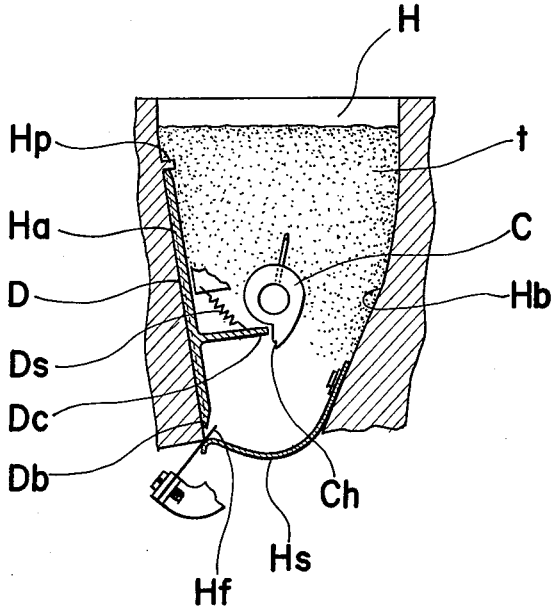
FIG. 1 (A) Prior Art
Figure 1:
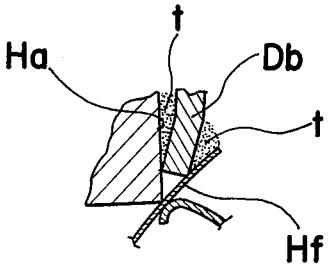
FIG. 1 (B) Prior Art
Figure 1:
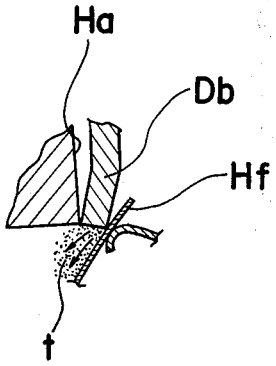
FIG. 1 (C) Prior Art

Before the description of the present invention proceeds, it is to be noted that like parts are designated by like reference numerals throughout the several views of the accompanying drawings.

Figure 2:
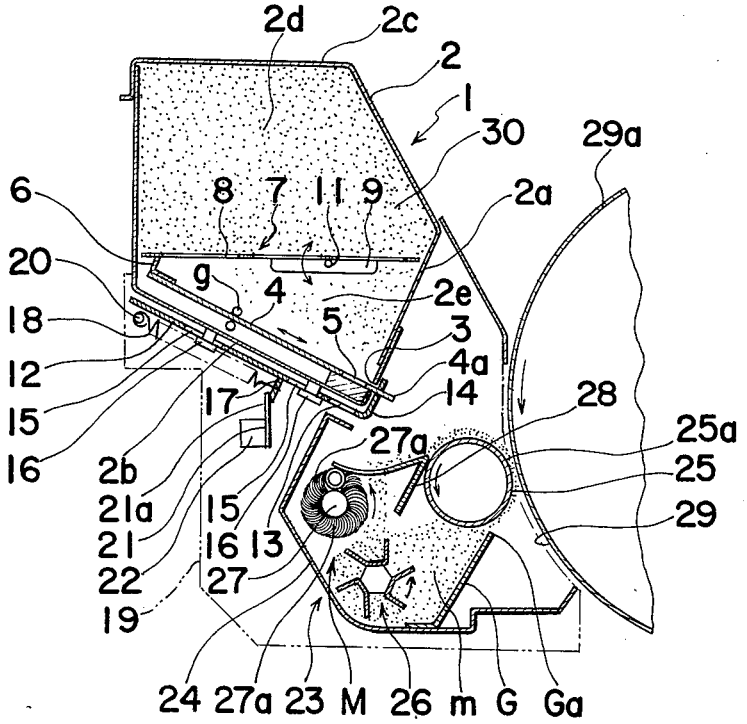
FIG. 2 is a schematic sectional view of a toner dispensing device according to one embodiment of the present invention which is associated with an improved developing material stirring and supplying means of a developing apparatus, and shows the toner supplying plate of a toner dispensing device in a retracted position.
Figure 3:
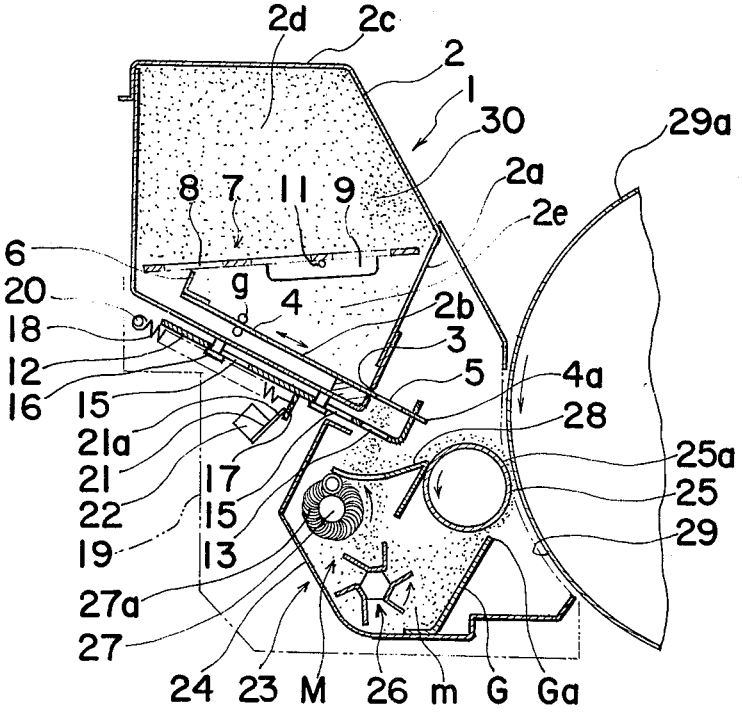
FIG. 3 is a view similar to FIG. 2, but particularly shows the toner supplying plate in a projected position.

Referring now to FIGS. 2 to 15, there is shown in FIGS. 2 and 3 a toner dispensing device 1 of the invention associated with a developing apparatus 23 of an electrophotographic copying machine. The device 1 generally includes a toner tank 2 filled with toner powder or toner particles 30 and mounted on a housing 24, for example, of the developing apparatus 23 of the magnetic brush type which is disposed adjacent to and in spaced relation to a known rotatable photoreceptor 29 of the drum type. In the housing 24 of the developing apparatus 23, immediately below the bottom portion of the toner tank 2, there is disposed developing material stirring and supplying means M which includes a stirring roll 27 having coil springs 27*a* spirally wound thereon and an impeller or runner 26 described later which is located below the stirring roll 27 and adjacent to a rotatable outer cylinder 25*a* of a developing roller 25 in which a plurality of stationary magnets (not shown) are fixedly disposed in a known manner for the formation of magnetic brush bristles of developing material *m* on the cylinder 25*a*. The stirring roll 27 and the impeller 26 are rotatable counterclockwise for stirring and supplying the developing material *m* housed in the housing 24 onto the outer cylinder 25*a* so as to form the magnetic brush bristles thereon to develop the latent image formed on the photoreceptor surface 29*a* of the drum 29 into the visible toner image, while a scraping plate 28 of approximately L-shaped cross section is disposed adjacent to the outer cylinder 25*a* of the roller 25 for scraping the developing material off the cylinder 25*a*, with one edge of the plate 28 contacting the springs 27*a* wound on the roll 27 in a manner described later.

The toner tank 2 of the toner dispensing device 1 further includes front and rear walls, side walls, an inclined bottom wall 2*b*, and a cover plate 2*c* releasably mounted on the tank 2. The lower half of the front wall of the tank 2 is slightly bent inward to form an inclined portion 2*a* which is provided at the lower portion thereof, with a slit 3 laterally, horizontally extending approximately across the width of the photoreceptor drum 29. A toner supplying plate 4 having a widthwise cross section similar to the shape of the slit 3 is slidably received in the slit 3 and supported between a pair of supporting members *g* secured to the side walls of the tank 2 and also by the lower edge of the slit 3 for reciprocating movement in a direction parallel to the inclined bottom wall 2*b* of the toner tank 2. An angle member 6 having an L-shaped cross section is secured parallel and adjacent to the rear edge of the plate 4 to form a toner bridging preventing projection 6 within the tank 2 as shown, with a plurality of square openings 5 for toner replenishing being formed in a row in the plate 4 adjacent to its front edge 4*a* as is most clearly seen from FIG. 6(A). Slightly spaced from the under surface of the inclined bottom wall 2*b* of the tank 2, there is slidably and reciprocatingly provided an operating plate 12 which is supported through elongated openings 15 formed therein by corresponding guide pins 16 secured to the bottom wall 2*b*. The operating plate 12 is provided with a connecting projection 14 extending upwardly at right angles from the forward edge thereof which is secured to the front edge 4*a* of the toner supplying plate 7, an engaging projection 17 extending downwardly at right angles from approximately the central portion of the under surface of the plate 12, and an opening 13 extending substantially the length of the slit 3 and having substantially the same width as that of the toner replenishing opening 5 of the toner supplying plate 4 for allowing the toner particles 30 to fall therethrough. The operating plate 12 is normally urged leftward in FIG. 2 by a return spring 18 connected between the engaging projection 17 and a pin 20 secured to the frame 19 of the copying machine so as to cause, the connecting projection 14 to contact the front wall 2*a* of the tank 2 at a position immediately below the slit 3 for restricting the return movement thereof so that its stops at a returned position. In a position adjacent to the engaging projection 17, there is provided an actuating cam 21 which is secured to a shaft 22 and is driven clockwise at a constant speed by a driving means (not shown), for example, by a developing apparatus driving motor, with an actuator 21*a* of the cam 21 being engagable with the projection 17 for driving the operating plate 12 rightward to project from the tank 2 as in FIG. 3.

Figure 4:
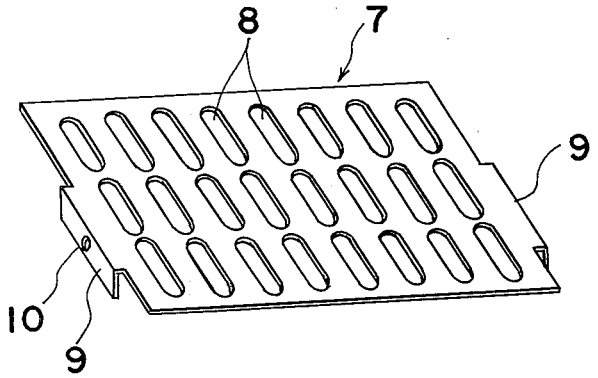
FIG. 4 is a perspective view of a stabilizing plate employed in the toner dispensing device of FIGS. 2 and 3.
Figure 5:
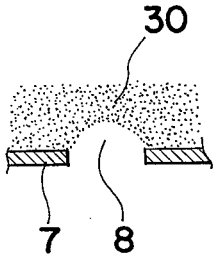
FIG. 5 is a fragmentary sectional view, on an enlarged scale, of the stabilizing plate of FIG. 4 particularly showing effective bridging of the toner powder around one opening thereof.

Referring also to FIGS. 4 and 5, further incorporated in an approximately central portion of the toner tank 2 is a stabilizing plate 7, which is generally of rectangular shape extending across the width of the toner tank 2 and having therein a plurality of rows of elongated openings 8 (FIG. 4). The plate 7 is further provided with a pair of side plates 9 extending downwardly from opposite side edges of the plate 7 and each having a small opening 10 through which the plate 7 is pivotally supported by corresponding pins 11 secured to the side walls of the toner tank 2. Since the small openings in the side plates 9 and the corresponding pins 11 are disposed in positions offset from the central portion of the plate 7 toward the right-hand forward edge thereof in FIGS. 2 and 3, the plate 7 is normally urged counterclockwise by its own weight, so that the left-hand rear edge of the plate contacts the upper edge of the bridging preventing projection 6 on the toner supplying plate 4 as shown in FIG. 2. The size of each of the elongated openings 8 of the stabilizing plate 7 is such as to cause a desirable bridging of the powdered toner 30 around the openings 8. as shown in FIG. 5, whereby the toner powder 30 is prevented from falling through the elongated openings 8 due to its weight alone.

It should be noted here that in the foregoing embodiment, although the bridging preventing projection 6 employed is described as being effective for preventing the bridging, such a projection need not necessarily be provided. More specifically, the effect of preventing the bridging of the toner is substantially determined by the size of the movable area of the toner supplying plate 4, and said projection 6 serves to further improve the effect of preventing toner bridging.

By the above arrangement, the operating plate 12 is initially retracted as in FIG. 2 by the force of the return spring 18 to the position whereat the projection 14 thereof contacts the front wall 2*a* of the tank 2, while the toner supplying plate 4 which is integrally connected at the front edge 4*a* thereof to the projection 14 of the plate 12 is also retracted to a position whereat the toner replenishing openings 5 thereof are located within the toner tank 2, whereby the openings 5 are filled with toner particles 30 by gravity. The stabilizing plate 7 which has the rear edge thereof contacting the bridging preventing projection 6 of the toner supplying plate 4 at this stage is held horizontal so as to divide the interior of the toner tank 2 into an upper portion 2*d* and a lower portion 2*e*. Since the desirable bridging is present at the openings 8 of the plate 7 as decribed earlier, the toner powder 30 housed in the lower portion 2*e* is free from the influence by the weight of the toner powder accommodated in the upper portion 2*d*.

Upon rotation of the actuating cam 21 clockwise by driving means (not shown), the actuator 21*a* thereof pushes the engaging projection 17 of the operating plate 12 forward, i.e., rightward in FIG. 3, and the plate 12 together with the toner supplying plate 4 advances rightward against the urging force of the spring 18 to such a position that the toner replenishing openings 5 thereof are out of the toner tank 2 (i.e., inside of the housing 24 of the developing apparatus 23), while the toner particles 30 filling the openings 5 are supplied, through the openings 13 of the operating plate 12, into the developing material *m* accommodated in the housing 24 of the developing apparatus 23. In this state, the stabilizing plate 7 is disengaged from the projection 6 on the toner supplying plate 4 and slowly rotates counterclockwise about the pins 11, in which rotation, the desirable bridging of the toner 30 on the plate 7 is still maintained, with the toner being prevented from falling through the openings 8 of the plate 7.

Subsequently, when the actuator 21*a* of the cam 21 is disengaged from the projection 17 of the plate 12 as the cam 21 further rotates clockwise, the operating plate 12 together with the toner supplying plate 4 rapidly returns to the initial position by the force of the return spring 18. In this case, the projection 6 of the toner supplying plate 4 strikes against the rear end of the stabilizing plate 7 to rapidly rotate the plate 7 clockwise, with consequent breakdown of the bridging of the toner powder at the openings 8 of the same plate 7, whereby the toner powder 30 is caused to freely fall through the openings 8, the amount of the thus supplied toner powder being approximately equal to that filling the toner replenishing openings 5 of the toner supplying plate 4. When the stabilizing plate 7 has returned to its original horizontal position, the desirable bridging of the toner is again produced at the openings 8 by the toner powder housed in the upper portion 2*d* of the toner tank 2.

Moreover, as the toner supplying plate 4 carries out one reciprocating movement for each rotation of the actuating cam 21 for replenishing the toner particles 30 from the openings 5, the projection 6 on the plate 4 stirs the toner particles housed in the lower portion 2*e* of the toner tank 2 for preventing the undesirable bridging of the toner particles in said lower portion 2*e*. It is to be noted here that, as stated earlier, the bridging of toner is substantially prevented by the reciprocating movements of the toner supplying plate 4, and the projection 6 provided on the one edge of the plate 4 serves to prevent the bridging phenomenon more effectively. Since the stabilizing plate 7 adapted to rotate in association with the reciprocating movement of the toner supplying plate 4 is provided, the weight of the toner powder 30 housed in the upper portion 2*d* of the tank 2 does not exert influence on the toner powder accommodated in the lower portion 2*e*, while the amount of the toner powder falling from the upper portion 2*d* into the lower portion 2*e* through the openings 8 of the plate 7 is approximately equal to that of the toner supplied from the toner replenishing openings 5 of the toner supplying plate 4, so that the toner powder housed in the lower portion 2*e* of the tank 2 is maintained at a predetermined amount at all times, and the toner to be filled into the openings 5 of the toner supplying plate 4 is constantly kept at uniform density. Therefore, because of the removal of excessive tone scraped off the toner supplying plate 4 by the upper and lower edges of the slit 3 as the openings 5 of the toner supplying plate 4 pass through the slit 3, the amount of the toner supplied by one reciprocation of the plate 4 is constantly uniform. For increasing or decreasing the amount of the toner particles supplied in a given time, the number of rotations of the actuating cam 21 may be changed or a stop member or the like (not shown) to engage the plate 12 may be provided to adjust the return position of the operating plate 12.

Figure 6:
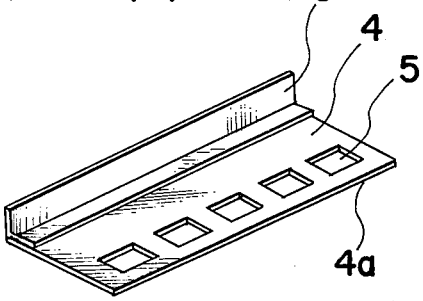
FIG. 6(A) is a perspective view of the toner supplying plate employed in the device of FIGS. 2 and 3.
FIG. 6(B) is a view similar to FIG. 6(A), but particularly shows a modification thereof.
Figure 6:
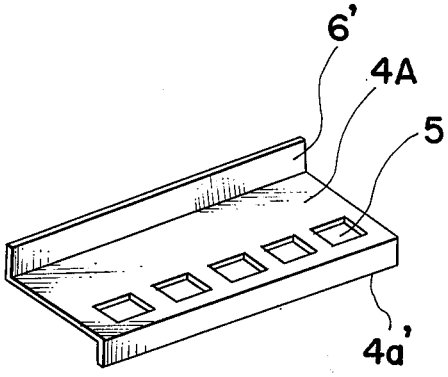

It should be noted here that the stabilizing plate 7, the toner supplying plate 4, the operating plate 12 and the associated developing device 23 are not limited in their configurations and constructions to those described in the foregoing embodiment, but may be modified in various ways within the scope of the invention. For example, the openings 8 described as formed in the stabilizing plate 7 are not limited in their configuration to the elongated openings having arcuate opposite ends, but may be formed into various other shapes, such as circular, rectangular or mesh-like shape so long as these serve the purpose of the desirable bridging and supplying the toner in the above described manner. Similarly, the stabilizing plate 7 described as subjected to the pivotal movement in the foregoing embodiment may be so modified that the plate 7 can reciproacte horizontally so as to be slowly moved toward right with the advance of the toner supplying plate 4 and subsequently returned rapidly toward left with the retraction of the plate 4. It should also be noted that the configuration of the toner supplying plate 4 as shown in FIG. 6(A) of the foregoing embodiment may be modified to that of a plate 4A in FIG. 6(B), with the bridging preventing projection 6' being integrally formed with the plate 4A at its rear edge, while the front edge thereof is bent downward at right angles to the surface of the plate 4A to form a connecting projection 4*a'* to be connected to the projection 14 of the operating plate 12. Furthermore, the square openings 5 described as formed in the toner supplying plate 4 in the embodiment of FIGS. 2 to 6(A) may be replaced by a single rectangular opening 5A of FIG. 7, a plurality of circular openings 5B of FIG. 8 or by openings of any other configuration so long as these openings serve the purpose of uniformly supplying the toner particles. It is needless to say that the corresponding openings 13 formed in the operating plate 12 may also be altered to suit the configurations of the openings 5 of the plate 4.

Figure 7:
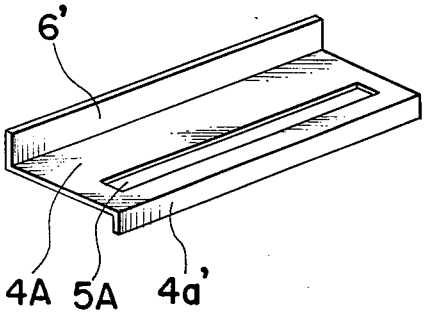
FIGS. 7 and 8 are views similar to FIG. 6(A), but particularly show further modifications thereof.
Figure 8:
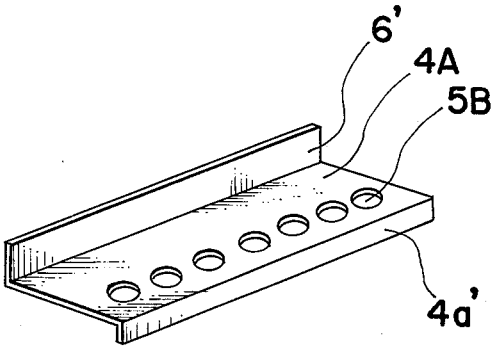
Figure 9:
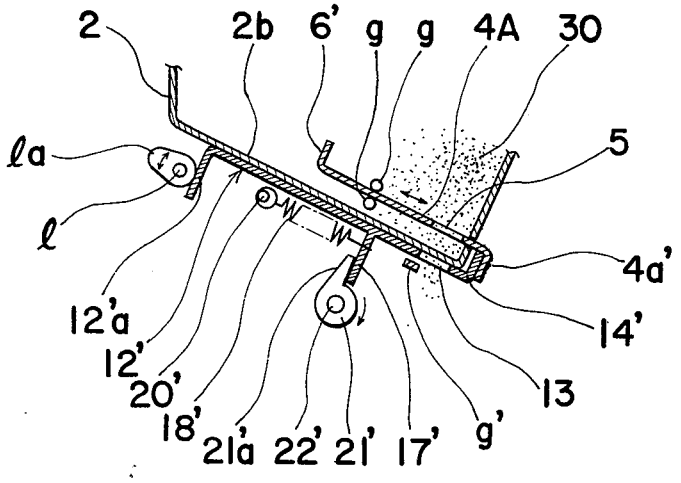
FIGS. 9 to 11 are fragmentary sectional views showing modifications of toner supplying plates and driving mechanisms therefor.
Figure 10:
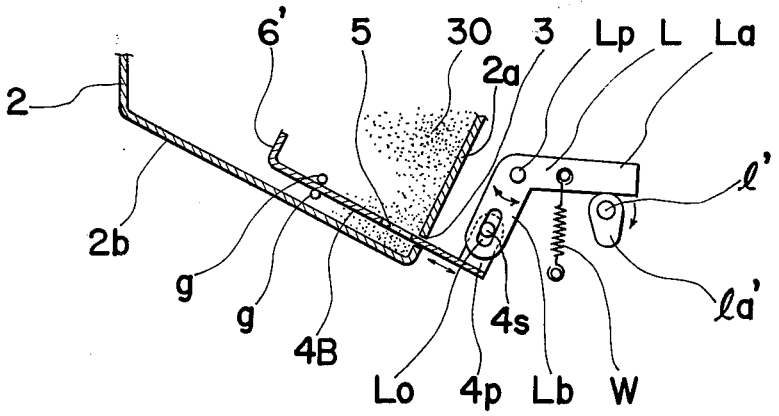
Figure 11:
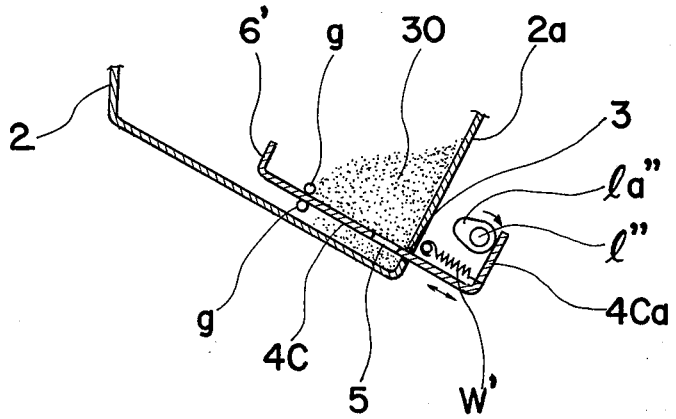

Referring now to FIGS. 9 to 11, there are shown modifications of the toner dispensing device 1 of FIGS. 2 and 3. In the modification of FIG. 9, the modified toner supplying plate 4A described with reference to FIG. 6(B), 7, or 8 is employed, while in contact with the under surface of the bottom wall 2*b*, there is slidably and reciprocatingly provided an operating plate 12' which is supported by a guide pin g' secured to a frame (not shown) of the copying machine. The operating plate 12' is provided with a connecting projection 14' formed at the forward edge thereof which is secured to the projection 4*a'* of the toner supplying plate 4A, a return restriction projection 12'*a* which extends downwardly from the rear edge of the plate 12', an engaging projection 17' extending downwardly at right angles from approximately the central portion of the under surface of the plate 12', and a plurality of openings 13 each having the same width as that of the toner replenishing opening 5 of the toner supplying plate 4A and corresponding in numbers and positions to said openings 5 for allowing the toner particles 30 to fall therethrough. The operating plate 12' is normally urged leftward in FIG. 9 by a return spring 18' connected between the engaging projection 17' and a pin 20' secured to the frame (not shown) of the copying machine so as to cause the return restriction projection 12*a* thereof to contact a restricting cam *la* fixedly mounted on a shaft *l* for resricting its return movement so that is stops at a particular returned position. In a position adjacent to the engaging projection 17', there is provided an actuating cam 21' which is fixedly mounted on a shaft 22' and is driven clockwise at a constant speed by a driving means (not shown), with an actuator 21'*a* on the cam 21' being engageable with the projection 17' for driving the actuating plate 12' in a direction away from the restricting cam *la,* while, upon disengagement of the actuator 21'*a* from the projection 17' as the cam 21' further rotates clockwise, the operating plate 12' together with the toner supplying plate 4A rapidly returns to the original retracted position by the urging force of the spring 18'.

In the modification of FIG. 10, the operating plate 12' having the cams 21' and *la* associated therewith described as employed in the modifications of FIG. 9 is dispensed with, and a modified toner supplying plate 4B has a projection 4*p* extending upwardly from a side edge of the plate 4B adjacent the forward edge thereof. In a position adjacent to and above the projection 4*p,* there is disposed an operating lever L which is substantially shaped and which is pivotally supported on a pin Lp secured to the frame (not shown) of the copying machine and is normally urged clockwise by a return spring W connected between one end of the lever L and the frame (not shown) of the copying machine. The other end Lb of the lever L has an elongated opening Lo in which a pin 4*s* secured on the projection 4*p* of the plate 4B is slidably received. The lower edge of the end La of the lever L engages an actuating cam *la'* fixedly mounted on a shaft l' and driven clockwise by driving means (not shown). In the above arrangement, the operating lever which is pivoted about the pin L*p* during each rotation of the cam *la'* causes the toner supplying plate 4B to reciprocate for supplying the toner particles 30 from the openings 5 to the developing apparatus 23 (FIGS. 2 and 3), with the toner particles 30 within the toner tank 2 being prevented from undesirable bridging by the movement of the projection 6' of the plate 4B.

In the modification of FIG. 11, the operating plate 12' described as employed in the modification of FIG. 9 is also dispensed with and a modified toner supplying plate 4C is provided with an engaging projection 4C*a* extending upwardly at right angles from the forward edge thereof, while a return spring W is connected between the lower portion of the projection 4C*a* and a pin secured to the frame (not shown) of the copying machine to normally urge the plate 4C leftward in FIG. 11, i.e., in a retracting direction. The inner upper portion of the projection 4Ca is in engagement with a cam *la''* fixedly mounted on a shaft *l''* and rotated clockwise by driving means (not shown). In this modification, the rotation of the cam *la''* is directly transmitted to the plate 4C and causes the plate 4C to reciprocate for each rotation of the cam *la''* for supplying the toner particles 30 from the openings 5 to the developing apparatus 23 (FIGS. 2 and 3), while the movement of the projection 6' formed at the rear edge of the plate 4C prevents the undesirable bridging of the toner particles 30 within the toner tank 2.

Other constructions and functions of the toner dispensing devices in the modifications of FIGS. 9 to 11 including the stabilizing plate 7 are similar to those in the embodiment of FIGS. 2 and 3, so that a detailed description thereof is omitted.

Referring back to FIGS. 2 and 3 and also referring to FIG. 12, the construction and function of the developing material stirring and supplying means for the developing apparatus will be described hereinbelow.

The developing material stirring and supplying means M includes, as mentioned earlier, the rotatable stirring roll 27 which is rotated in synchronization with the rotation of the developing roller 25 and on the outer periphery of which a plurality of coil springs, for example, two coil springs 27*a* are wound and suitably secured by securing screws (not shown), and the stirring and supplying impeller 26 rotatably disposed below the roll 27. It should be noted here that the stirring roll 27 has for its object to expedite stirring of the developing material and also to sufficiently pulverize or smash the toner 30 before it is supplied onto the developing roller by the stirring impeller 26, even if a considerable amount of the toner is added to the developing material at each operation the toner dispensing device, thereby preventing insufficiently pulverized toner from adhering to the photoreceptor to spoil the developed image or from soiling various portions in the vicinity of the developing apparatus. The scraping plate 28 of resilient material disposed adjacent to the developing roller 25 has on its upper surface 28*a* a plurality of notches 28*b* spaced at regular intervals to form corresponding tongue portions 28*c* which contact, at their ends 28*d,* the springs 27*a* on the roll 27 and are alternately raised or lowered by the springs 27*a* as the roll 27 rotates as shown, so that the developing material *m* scraped off by the scraping plate 28 is caused to move not only in the direction of rotation of the roll 27, but in the axial direction of the developing roller 25 as shown by dotted arrows in FIG. 12, by its impingement on the windings of the coil springs 27*a,* and subsequently falls onto the impeller 26 disposed thereunder. On the other hand, the developing material stirring and supplying impeller 26 includes core member 26*a* of hexagonal cross section extending across the width of the slit 3 of the toner dispensing device, and rotated in synchronization with the rotatable outer cylinder 25*a* of the developing roller 25, and blade members 26*b* of substantially U-shaped cross section each having a pair of opposed blade portions 26*c* and axially secured to every other face of the hexagonal core member 26C. Each of the blade portions 26*a* of the blade members 26*b* is provided with cut out portions 26*d* of predetermined lengths at regular intervals to form blades 26*e* therein in such a manner that the cut out portions 26*d* of one of the blade portions 26*c* to not coincide with those of the other of the blade portions 26*c* or with the cut out portions of the neighboring blade members 26*b*. By the above arrangement, when the stirring roll 27 and the impeller 26 are rotated in the direction of the solid line arrows in FIG. 12 by driving means (not shown) as the developing roller 25 rotates, the developing material *m* used for the development of the latent image on the photo-receptor in the form of the magnetic brush bristles formed on the developing roller 25 is scraped off from the roller 25 by the scraping plate 28. The developing material *m* thus scraped off is directed in three directions as shown by the dotted arrows in FIG. 12 when it passes through the scaping plate 28 since the tongue portions 28*c* of the plate 28 are subjected to alternate upward and downward movements as the coil springs 27*a* of the stirring roll 27 rotate together with the roll 27, and then falls onto the blades 26*e* of the blade portions 26*c* of the impeller 26, with some of the developing material *m* passing through the cut-out portions 26*d* onto the blades 26*e* of neighboring blade member 26*b*, while other of the same material *m* remains on the particular blades 26*e* to be repeatedly moved in the above described manner as the impeller 26 rotates. Accordingly, even if a large amount of toner powder is supplied from the toner dispensing device 1, such toner powder is perfectly pulverized or smashed into fine particles by the upward and downward movements of the tongue portions 28*c* of the scraping plate 28 and sufficiently stirred by the roll 27, while the same developing material which is subsequently supplied onto the impeller 26 is subjected to the complicated movement in the above described manner within the housing 24 to tribo-electrically charge the toner particles 30 uniformly by the magnetizable carrier material, and the material is then supplied to the developing roller 25 by the blades 26*e* of the impeller 26. It is to be noted here that any excess amount of the developing material m supplied onto the developing roller 25 is removed therefrom by the restricting edge G*a* of a guide plate member G extending upwardly from the bottom plate of the developing apparatus housing 24 toward a position adjacent to the lower right portion of the developing roller 25, and only the necessary amount of the developing material m is supplied onto the developing roller 25 for the formation of the magnetic brush bristles (not shown) thereon to develop the latent image on the photoreceptor drum 29.

Figure 12:
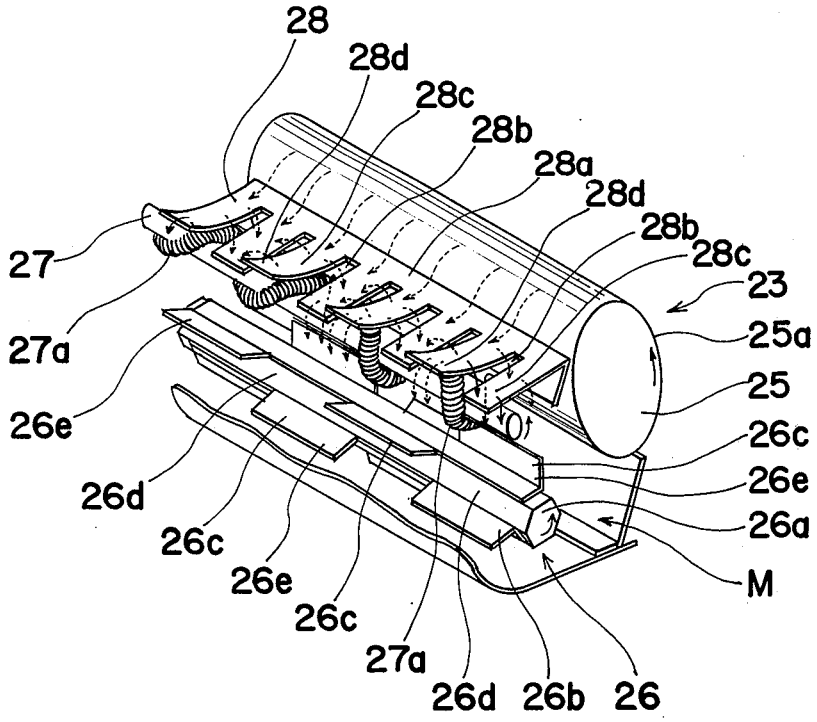
FIG. 12 is a perspective view, partly broken away, showing the construction of developing material stirring and supplying means associated with the device of FIGS. 2 and 3 and flow of toner powder therein.
Figure 13:
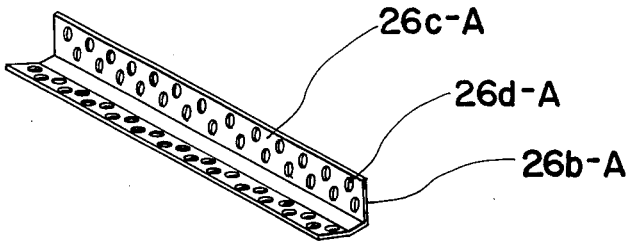
FIGS. 13 to 15 are perspective views showing modifications of a blade member employed in the developing material stirring and supplying means in FIG. 9.
Figure 14:
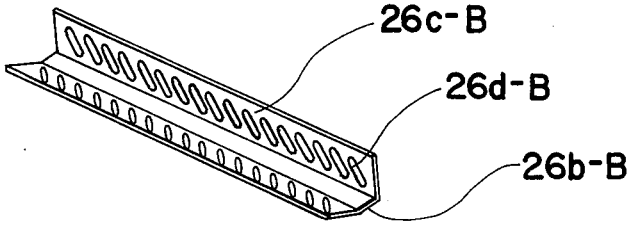
Figure 15:
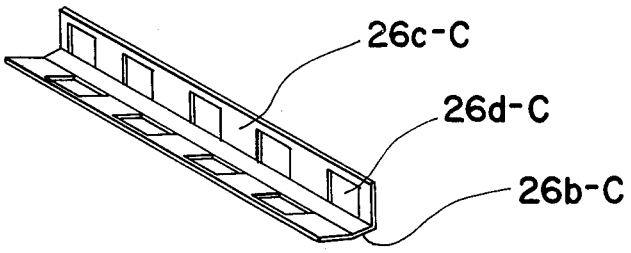

It should also be noted that, in the foregoing embodiment, although the stirring of the developing material *m* is mainly effected at the cut out portions 26*d* formed in the blade member 26*b*, the configuration of the blade member 26*b* is not limited to that shown in the embodiment of FIG. 12, but may be modified to any other shape, for example, as shown in FIGS. 13 to 15 so long as efficient stirring and supplying action of the developing material m are available therefrom.

In the modified blade member 26*b*-A, 26*b*-B and 26*b*-C of FIGS. 13 to 15, the cut out portions 26*d* described as formed in the blade member 26*b* of the embodiment of FIG. 12 are respectively replaced by a plurality of small circular openings 26*d*-A arranged in a zigzag pattern in the blade portion 26*c*-A, a row of a plurality of small elongated openings 26*d*-B extending diagonally to the length of the blade portion 26*c*-B, and comparatively large rectangular openings 26*d*-C formed at regular intervals in the blade portion 26*c*-C. The functions of the blade members 26*b*-A, 26*b*-B and 26*b*-C are similar to that of the blade member 26*b* of FIG. 12, so that a detailed description thereof is omitted.

Particularly referring to FIGS. 2 and 3, by the above arrangement, the toner supplying plate 4 reicprocates together with the operating plate 12 during each rotation of the actuating cam 21, and the toner particles 30 are supplied through the stirring roll 27 onto the blades 26*e* of the impeller 26 from the openings 5 of the plate 4 through the corresponding openings 13 of the plate 12. The toner particles 30 thus supplied are stirred and tribo-electrically charged in the earilier described manner as the impeller 26 rotates so as to be attracted to the carrier material in the developing material *m* and to be subsequently supplied onto the developing roller 25 along the guide plate G. The developing material *m* thus supplied onto the roller 25 forms the magnetic brush bristles (not shown) in the known manner on the rotating outer cylinder 25*a* of the roller 25, with the height of the brush bristles being adjusted by the edge Ga of the guide plate G to develop the latent image previously formed on the photoreceptor surface 29*a* of the photoreceptor 29 as the outer cylinder 25*a* of the developing roller 25 rotates. The magnetic brush bristles of the developing material *m* are scraped off by the scraping plate 28 from the surface of the outer cylinder 25*a* after the developing and are again supplied onto the impeller 26 through the stirring roll 27, while the supply of developing material *m* is replenished with fresh toner 30 supplied from the toner dispensing device 1 in the earlier described manner.

As is clear from the foregoing description, according to the toner dispensing device of the present invention, since the stabilizing plate is provided within the toner tank for dividing the toner tank into two portions, the toner powder accommocated in the lower portion is unaffected by the weight of the toner housed in the upper portion of the toner tank irrespective of the increase or decrease in the amount of the latter, and nevertheless the toner powder in the upper portion is constantly supplied to the lower portion in the earlier described manner, so that the amount of toner in the lower portion is maintained at a predetermined level and at a uniform density at all times, thus the toner powder being stably supplied at predetermined rates for producing good copied images, while the undesirable hardening of toner within the toner tank is advantageously prevented. Furthermore, since the amount of toner supplied by one reciprocating movement of the toner supplying plate is equal to the volume of the toner supplying openings formed in the supplying plate, a uniform amount of the toner is supplied at all times, while the increase or decrease of the amount is readily effected by the alteration of the number of rotations of the supplying plate driving means. Moreover, the undesirable bridging of the toner particles is advantageously prevented by the provision of the bridging preventing projection formed on the toner supplying plate, simultaneously with the supplying of the toner particles, without requiring provision of any other separate bridging preventing means. Moreover, in the developing material stirring and supplying means associated with the toner dispensing device of the invention, the toner and magnetizable carrier material of the developing material scaped off the developing roller by the scraping plate are efficiently stirred by the stirring roll having the spring members wound thereon for sufficient and uniform tribo-electrical charging of the toner particles by the carrier material, while the developing material thus stirred is further subjected to complicated movement by the blades and cut out portions formed in the blade members of the impeller for further stirring and triboelectrical charging, whereby various inconveniences inherent in the conventional developing apparatuses such as uneven developing of the latent image on the photoreceptor, fogging or blurring of the developed images mainly due to insufficient tribo-electrical charging of the toner particles are advantageously eliminated, and driving force required for rotating the impeller being substantially reduced by the presence of the cut out portions in the blade members of the impeller.

It is to be noted here that in the foregoing embodiments, although the present invention is mainly described with reference to the magnetic brush type developing apparatus, the toner dispensing device of the invention and the developing material stirring and supplying means associated therewith are not limited in their application to the magnetic brush type developing apparatus, but may readily be applicable to the known cascade type developing apparatus and the like.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is:

1. A toner dispensing device for use in an electrophotographic copying machine having a dry process developing apparatus, said toner dispensing device comprising a toner container disposed adjacent the developing apparatus for accommodating therein toner for replenishing toner used by the developing apparatus and having a bottom portion extending toward said developing apparatus, slit means in said bottom portion of said container between said toner container and said developing apparatus, a first plate member movably disposed along said bottom portion of said toner container for reciprocation through said slit means, said first plate member having bridging preventing means thereon and having at least one toner supplying opening therein adjacent the end thereof and which is positioned in said first plate member for being projected through said slit means to a first position in said developing apparatus and retracted through said slit means to a second position in said toner container during the reciprocation of said first plate member for transporting toner which fills said toner supplying opening when said first plate member is within said toner container out of said toner container as said opening in said first plate member is projected to said first position through said slit means, and a second plate member for stabilizing the toner and having a plurality of openings therein and being movably mounted in said toner container above said first plate member for dividing the interior of said toner container into upper and lower portions each containing toner therein, said second plate member being movable in association with the reciprocation of said first plate member for causing toner to pass through said openings in said second plate member into said lower portion of said toner container.

2. A toner dispensing device as claimed in claim 1 wherein said first plate member has spring means connected thereto for normally urging said first plate member to said second position, and said device further has cam means engagable with said first plate member for driving said first plate member to said first position, said first plate member being returned to said first position by said spring means upon disengagement of said cam means from said first plate member.

3. A toner dispensing device as claimed in claim 1 further comprising a lever means connected to said first plate member, cam means for pivoting said lever means for moving said plate member in the direction toward said first position, and spring means connected to said lever for pivoting said lever in the opposite direction from the direction in which it is driven by said cam means for moving said first plate member in the direction toward said second position.

4. A toner dispensing device as claimed in claim 1 further comprising a cam means engaged with said first plate member for driving said first plate member in the direction toward said first position, and spring means connected to said first plate member for moving said first plate member in the direction toward said second position.

5. A toner dispensing device as claimed in claim 1 wherein said bridging preventing means is a projection on the other end of said first plate member from said opening.

6. A toner dispensing device as claimed in claim 5, wherein said second plate member is pivotally disposed at central portion of said toner container, said second plate member normally being held horizontal by the engagement thereof with said projection on said first plate member when said one edge of said first plate member is in said second position, and being pivoted to an inclined position upon movement of said projection when said one edge of said plate member is projected to said first position, said second plate member being struck by said projection on said first plate member upon retraction of said one edge of said first plate member to said second position during the reciprocation of said first plate member for causing the toner housed in said upper portion to fall into said lower portion through said openings formed in said second plate member.

7. A toner dispensing device as claimed in claim 1, wherein said second plate member is horizontally, reciprocatingly disposed in the central portion of said toner container, said second plate member being movable in one direction at a low speed as said one edge of said first plate member is moved to said first position and movable in the other direction at a high speed as said one edge of said first plate member is moved to said second position.

* * * * *